US009435179B1

(12) United States Patent
McIntyre et al.

(10) Patent No.: US 9,435,179 B1
(45) Date of Patent: Sep. 6, 2016

(54) APPARATUS FOR CAPTURING OIL AND GAS BELOW THE SURFACE OF THE SEA

(76) Inventors: Christopher McIntyre, Anchorage, AK (US); Roy Longacre, Anchorage, AK (US)

( * ) Notice: Subject to any disclaimer, the term of this patent is extended or adjusted under 35 U.S.C. 154(b) by 791 days.

(21) Appl. No.: 13/200,208

(22) Filed: Sep. 21, 2011

(51) Int. Cl.
*E02B 15/04* (2006.01)
*E21B 43/01* (2006.01)
*E02B 15/08* (2006.01)

(52) U.S. Cl.
CPC ..... *E21B 43/0122* (2013.01); *E02B 15/0814* (2013.01); *E02B 15/0857* (2013.01)

(58) Field of Classification Search
CPC ..... E02B 15/08; E02B 15/0807; E02B 15/0814; E02B 15/0857
USPC ..... 405/53, 60, 63, 64, 66, 210
See application file for complete search history.

(56) References Cited

U.S. PATENT DOCUMENTS 3,548,605 A * 12/1970 Paull et al. ..... 405/60
3,610,194 A 10/1971 Siegel
3,664,136 A * 5/1972 Laval et al. ..... 405/60
3,727,766 A * 4/1973 Horne et al. ..... 210/242.3
4,351,623 A * 9/1982 Heinz et al. ..... 405/210
4,402,632 A * 9/1983 Cook ..... 405/210
4,531,860 A 7/1985 Barnett
4,556,343 A * 12/1985 Cheung ..... 405/210
5,050,680 A * 9/1991 Diehl et al. ..... 166/356
5,129,759 A * 7/1992 Bishop ..... 405/59
5,213,444 A 5/1993 Henning
7,703,613 B2 * 4/2010 Haslem ..... 210/513
2010/0038324 A1 2/2010 Couch
2012/0155964 A1 6/2012 Carter et al.
2012/0213587 A1 8/2012 Le Bas et al.
2012/0251244 A1 10/2012 Toedtman

FOREIGN PATENT DOCUMENTS

GB 2063776 A 6/1981
GB 2071020 A * 9/1981 ..... B63B 35/44

* cited by examiner

*Primary Examiner* — Tara M. Pinnock
(74) *Attorney, Agent, or Firm* — Michael J. Tavella

(57) ABSTRACT

A collection device for collecting oil and gas that is placed near the sea floor over a leak or seep. The device is anchored to the seabed. It has a long body and a head into which oil and gas can flow and be captured. An extraction system is attached to the collector that utilizes long tubes to collect both the oil and gas and bring them to the surface. The collector can be used singly or it can be combined with many others to form a complete collection system.

17 Claims, 4 Drawing Sheets

APPARATUS FOR CAPTURING OIL AND GAS BELOW THE SURFACE OF THE SEA

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to offshore oil spill collection devices and particularly to offshore oil spill collection devices that operate below the surface of the sea to collect oil and gas.

2. Description of the Prior Art

Damage to the environment by leaking oil or gas from underwater pipelines or oil wells has become a serious problem. Costs to remove oil coming to the surface via these leaks from an underwater well or pipeline are tremendous. In addition, the loss of the oil can be in hundreds or thousands of barrels a day, which is a significant loss of a vital natural resource. Recent events in the Gulf of Mexico illustrate the extent and seriousness of this problem.

The main techniques for dealing with such leaks or spills have been removing the oil from the surface of the water and land, and cleaning wildlife. However, simply cleaning up the oil is not sufficient to prevent or reduce the loss of a vital natural resource. In the recent Gulf spill, millions of gallons of oil were burned off or simply disbursed into the sea, where they may be accumulating on the sea floor.

In addition to oil leaks, there are natural methane and oil seeps located below the surface of the sea. Such seeps can provide a source of gas and oil, while the recovery of such gas helps control the emission of a greenhouse gas into the environment.

Oil recovery apparatus can be effective in preventing the contamination caused by oil and oil/gas leakage from underwater pipelines or oil wells. For example, a large number of oil wells are located offshore in deep water and rupture of a well casing, etc., causes the oil/gas to be discharged upwardly under pressure from the oil well, resulting in a loss of oil. Presently, there are few devices that are used to collect leaked or spilled oil from the sea. One such device is found in U.S. Pat. No. 5,213,444 to Henning. This device is a housing that is positioned above an underwater leak and anchored in place. As the oil and gas rise in the water column, the device can trap the oil and gas within the housing. The device has a vent with a burner that can be used to burn off the gas. It also has a pump to remove the oil that is collected. Although this device seems to be a good solution, it has several problems. First, the device must be positioned so that the top of the housing is above the water. This is to allow the gas to be burned off and the oil to be pumped onto barges or other vessels. However, it is difficult to maintain such a device in such a position because of currents, wave action and storms. Moreover, in many cases the oil pipelines or wells are at great depths (the gulf well in the recent spill was over a mile deep). A column of oil rising from that great a depth will be dispersed by currents and wave action long before it breaks the surface. Even a large number of such devices placed on the surface will only collect minor amounts of such oil.

At present, there is no such device for capturing such gas and oil from undersea seeps. Therefore, there is a need for a collection system that can operate under the surface so that it can be positioned to collect both leaking and seeping oil and gas from the sea floor.

BRIEF DESCRIPTION OF THE INVENTION

The instant invention solves these problems by providing an apparatus for collecting seeps, and spills from producing oil wells and ground seeps. It is a collection device that is placed near the sea floor over a leak or seep. The device is anchored to the seabed. It has a long body into which oil and gas can flow and be captured. An extraction system is attached to the collector that utilizes long tubes to collect both the oil and gas and bring them to the surface. The collector can be used singly or it can be combined with many others to form a complete collection system. The overall system can include a gathering plant where the oil and gas are separated, cleaned and stored for transport. This system is the subject of our copending applications entitled "System for Capturing Oil And Gas Below the Surface of the Sea" and "Method for Capturing Oil And Gas Below the Surface of the Sea using a Collection system".

In this application the collector is placed over a seep or a leaking well below the surface, and a temporary subsea storage/recovery of methane gas vessel is positioned on the surface to collect the gas and oil.

DETAILED DESCRIPTION OF THE INVENTION

Figure 1:
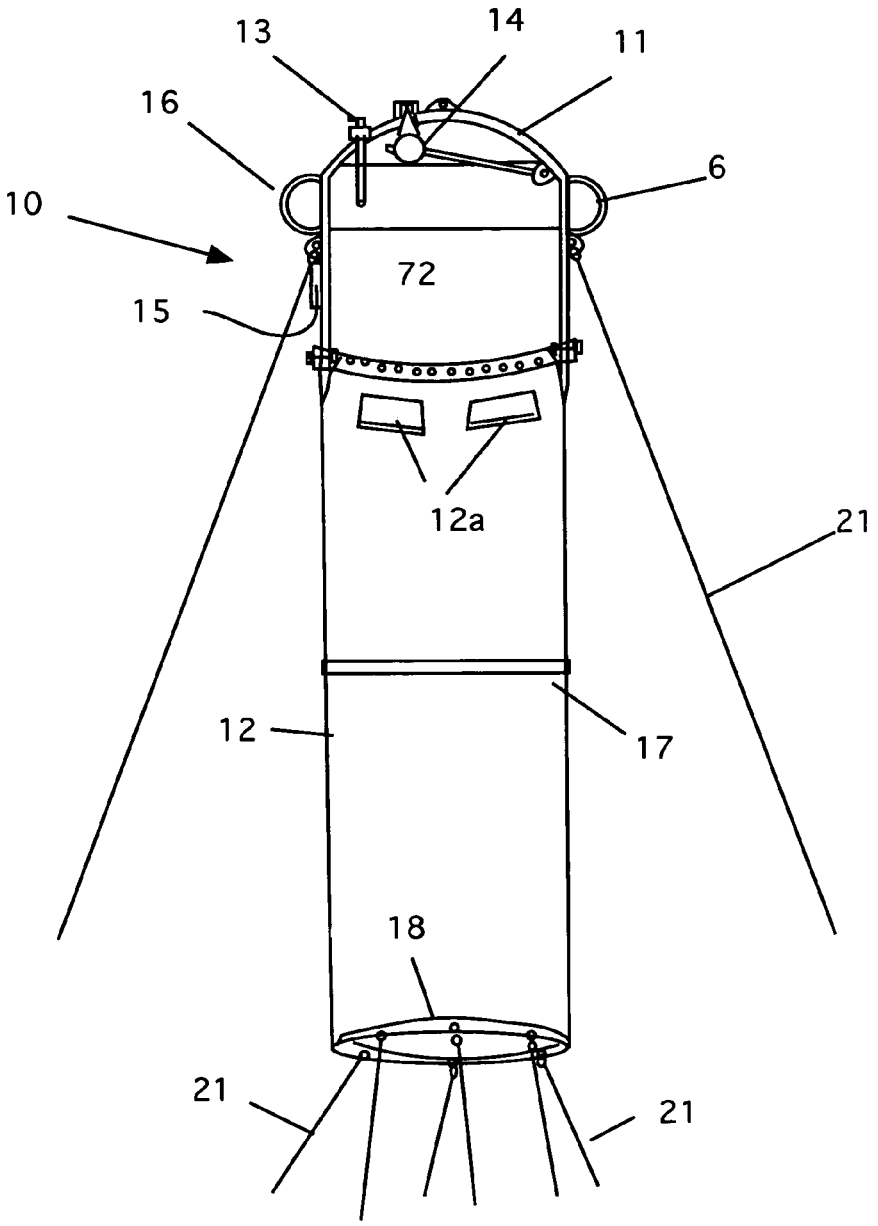
FIG. 1 is a detail side view of an undersea collector.

FIG. 1 is a detail side view of an undersea collector 10. The collector 10 has a domed top 11 and a chute 12 that is attached to the dome using any number of fasteners known in the art. The top 11 includes an oil port 13 and a float 14 (which are shown in detail in FIG. 3 and discussed below.

Figure 2:
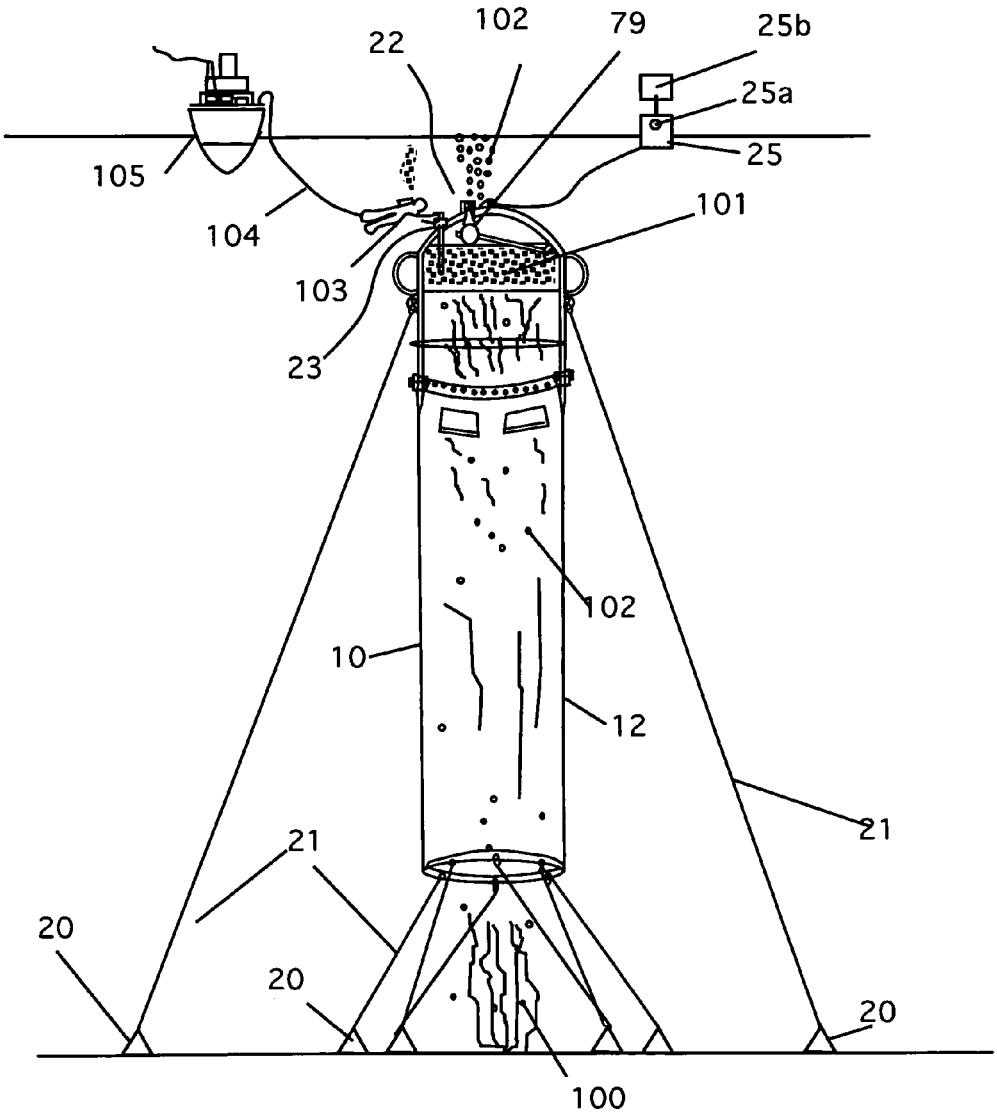
FIG. 2 is a detail side view of an undersea collector shown installed.

The chute 12 has flaps 12*a* that are provided to quickly vent in case of an excessive blowout from the source (see, e.g., FIG. 2).

The dome has a means for determining the level of oil contained in it. In the preferred embodiment, this means is an underwater specific gravity sensor 15 that can measure oil level. Other sensors, such as a light refraction sensor or any other similar suitable sensor can be used. The sensor 15 also contains a means for transmitting data from the sensor, and thus has the ability to transmit data to the service. When the sensor detects a sufficient of oil in the dome, the data transmitter initiates operation of a pump (see below).

The collector has a number of float rings 16 (see also FIG. 3) that can be filled with gas and water to help displace the weight of the domed top 11. In addition, buoyancy rings 17 can be attached to the chute to help support chutes made of heavy material or for extremely long chutes. A ring 18 is attached to the bottom of the chute to keep the chute open and allows anchoring via cable lines to weights.

In normal use the collector 10 is anchored to the seafloor with concrete anchors 20 (FIG. 2) and cables 21.

Note also that all of the materials used for the collector 10 are made to be corrosion free in the environment used. For example, the domed top 11 is preferably made of heavy plastic or fiberglass. The chute 12 is preferably made of vinyl or polyethylene. The valves, cables anchors, pick-up tube and float are preferably stainless steel.

FIG. 2 is a detail side view of an undersea collector shown installed on the seafloor. In this view the collector is used as a stand-alone device. FIG. 2 shows a collector 10 anchored to the sea floor positioned above a seep 100 in the ocean floor.

The seep emits oil 101 and gas 102, which enter the chute 12 as shown. The gas and oil rise to the top of the dome 11. Although the collector can be used for oil and gas recovery, here, the collector is used for oil recovery. Oil 101 collects at the top of the dome as shown. Methane 102 is vented out of the top vent 22. A shut-off valve, attached to vent 22 is used to stop the venting when oil is being recovered, if desired for safety. Note that the vent can be connected to a flexible pipe for recovery, as well. The figure shows a diver 103 attaching a hose 104 to the port 23 for transfer to a ship 105. Note that for safety, a tethered buoy 25 having an offloading port 25*a* and sign 25*b* are used to warn of venting whenever a collector is positioned on the sea floor.

In the preferred embodiment, the oil transfer is done using a seawater injected transfer pump that injects seawater into the collector's vane pump, sucking the oil from the collector via a pick up tube.

Figure 3:
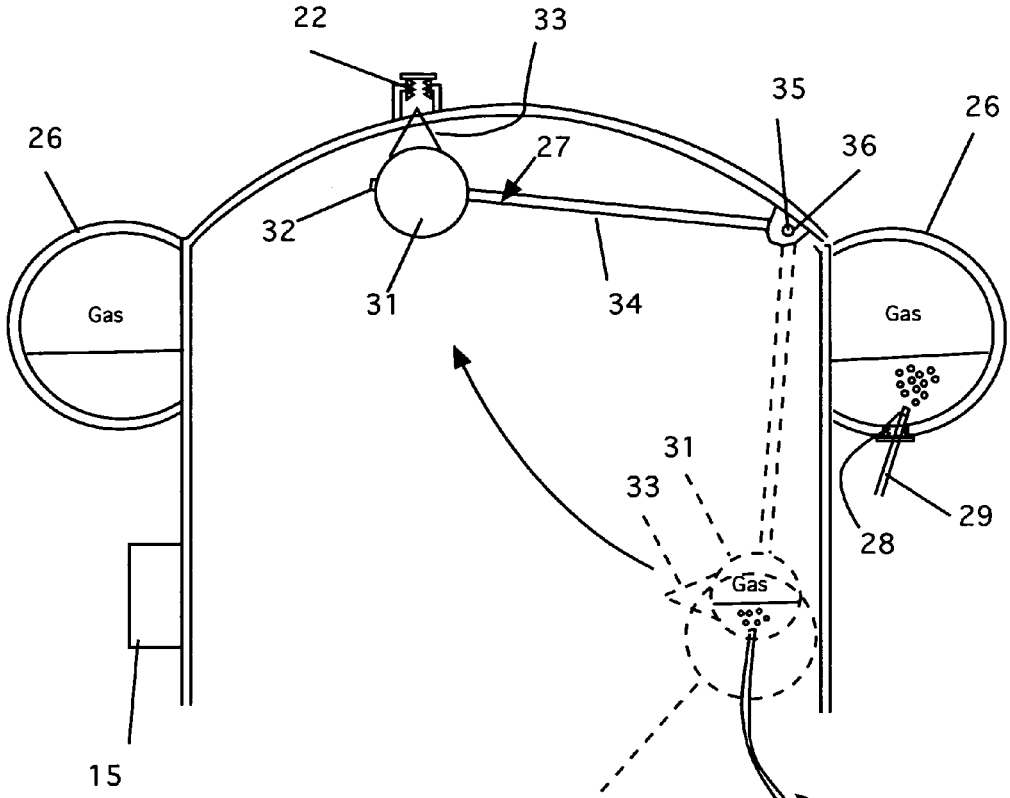
FIG. 3 is a detail view of an undersea lift device showing water displacement within the device.

FIG. 3 is a detail view of an undersea lift device showing water displacement within the device. This figure shows the float rings 26 and the float 27. As noted above, float rings 26 are positioned around the domed top of the collector. Note that although two rings 26 are shown, more can be used to provide greater stability for the unit. The float rings have a one-way valve 28 installed to allow the introduction of gas into the rings through hose 29. The gas is added until sufficient water has been displaced to achieve the desired level of neutral buoyancy for the collector.

Also as noted above, the domed top has the float 27 installed. The float 27 has a ball 31 that has a fill port 32 like that of the float rings. The float 27 also has a cone shaped end 33 that is used to seat the top vent 22 as shown. The float is designed to pivot. The ball 31 is attached to a swing arm 34, which is secured by a pivot pin 35 in a bracket 36. The pivot arm allows the float to move with the amount of water and oil vs. gas in the collector. As in the case of the float rings, buoyancy is obtained by injecting gas into the ball 31 using a hose 37 or similar apparatus.

Figure 4:
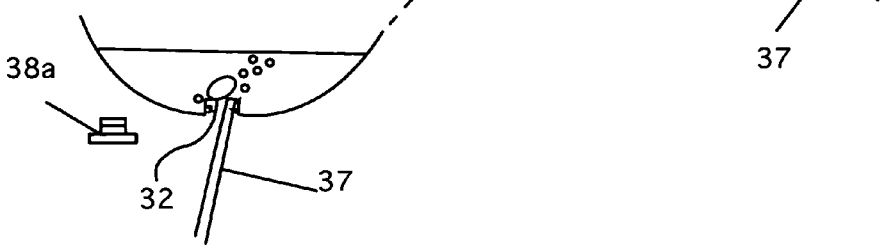
FIG. 4 is an enlarged inset view of the float inside the undersea lift device.

FIG. 4 is an enlarged inset view of the float inside the undersea lift device. In this figure, the fill port 32 is shown enlarged. Although preferably the ill port is a one-way valve for ease of use, it is possible to use threaded plug 38*a* to make a seal, if desired.

Figure 5:
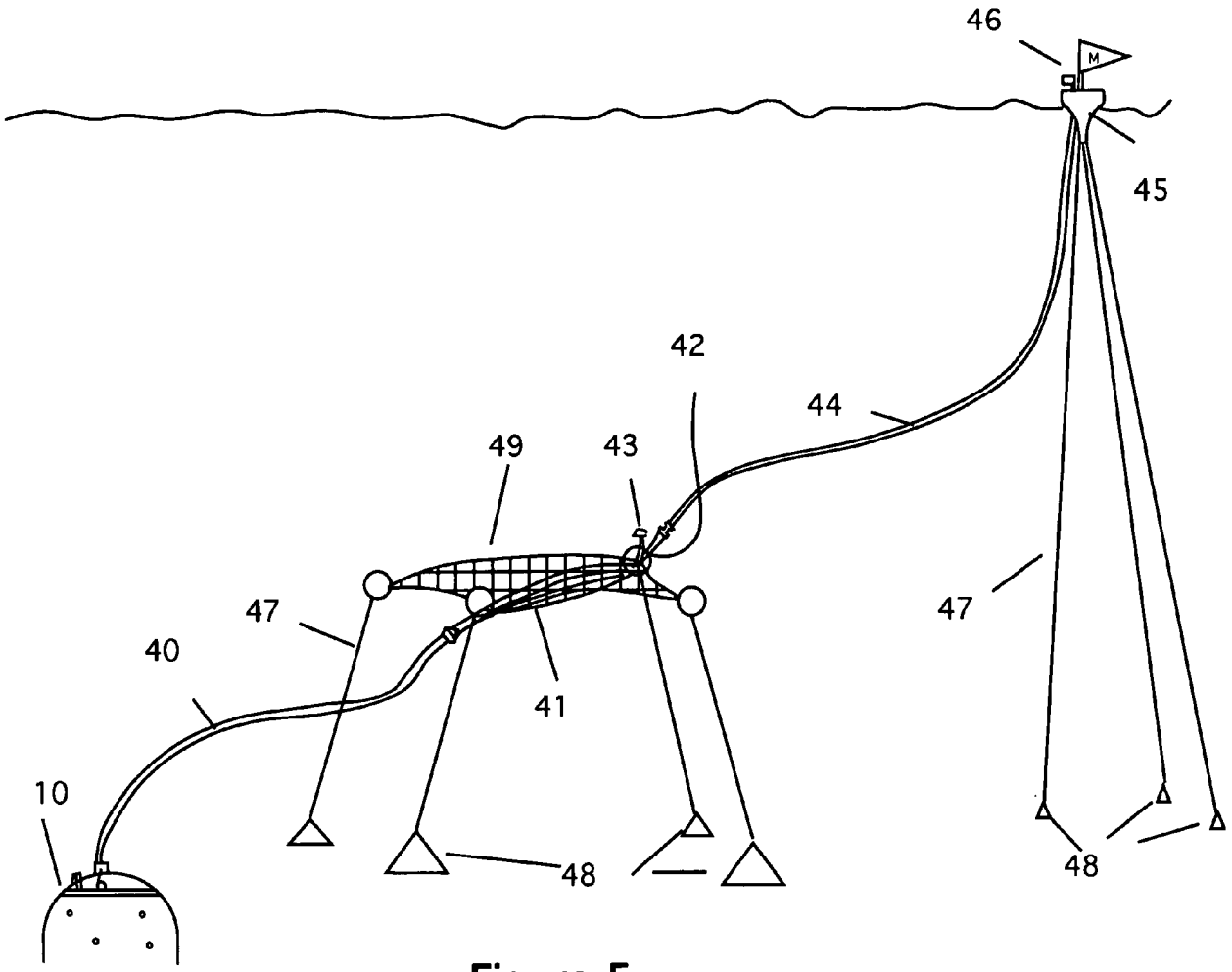
FIG. 5 is a detail view of a temporary subsea methane gas recovery system.

FIG. 5 is a detail view of a temporary subsea methane gas recovery system. As shown in FIG. 2, the collector 10 can be used as a stand-alone device. In FIG. 2, an oil recovery system was disclosed. In this figure, a gas recovery system, with a means for temporarily storing methane is disclosed. Here, a collector 10 is shown with a line 40 attached to the gas outlet 42. A large methane bladder (balloon) 41 is attached to the line 40. The balloon 41 has an outlet 42 that has a pressure relief valve 43 attached. An outlet hose 44 is attached to the outlet. Note that the outlet hose 44 can be a hose or line. It is preferably a flexible line. The outlet hose rises to the surface, where it is connected to a buoy 45 that is anchored with cables 47 and weights 48. A discharge nipple 46 is installed on the buoy for collection of the gas by a vessel. To secure the balloon and keep it below the surface, a net 49 is used. The net is also anchored to the bottom using cables 47 and weights 48. In this way, gas can be accumulated in the balloon and loaded when conditions permit.

Collectors are ideally installed above leaks and seeps to allow natural induction flow. They are set 20-100 meters below ocean surface depending on ocean currents (avoid currents where possible). Lower is better, but the dome should be set above the free methane/methane hydrate interface boundary.

The collectors are marked for passing vessels as a danger area with underwater obstacles and are monitored regularly. Oil is recovered at regular intervals with or without use of specific gravity sensors.

The collector is manufactured in different diameters to handle different flow rates and in different lengths to handle greater depths. Additionally, the collectors can be made with different dome shapes to cover a variety of seep shapes for maximum collection—as long as float and gas vent remain at the highest points available. Multiple collectors of circular design, set side by side, would generally suffice for most seeps.

The collectors can be used independently or in conjunction with a Compressed Natural Gas (CNG) facility. If the device is not used in conjunction with a process facility it is recommended that it be used with apparatus for temporary subsea storage/recovery of methane gas.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. An apparatus for capturing oil and gas below the surface of the sea comprising:

a) a domed top, having a semi-spherical upper surface and an open lower perimeter having a diameter;

b) a cylindrical chute having a vertical side surface, an open upper perimeter having a diameter equal to the diameter of the lower perimeter of said domed top, said cylindrical chute being attached to the domed top, and extending vertically downward therefrom, said cylindrical chute also having a lower open perimeter having a diameter equal to that of the diameter of the open upper perimeter of said chute;

c) an oil port installed in the semi-spherical upper surface of said domed top;

d) a gas vent, installed in the semi-spherical upper surface of said domed top; and e) a means for anchoring said apparatus to the sea floor such that the entire apparatus is suspended below the surface of the sea and the domed top is completely underwater.

2. The apparatus of claim 1 further comprising a float installed in said domed top.

3. The apparatus of claim 1 wherein the chute has at least one flap for allowing quick venting from said apparatus.

4. The apparatus of claim 1 further comprising:

a) a means for determining a level of oil in said domed top; and b) a means for transmitting data from said means for determining a level of oil in, installed in said domed top and being in communication with said means for determining a level of oil.

5. The apparatus of claim 4 wherein the means for determining a level of oil in said domed top comprises an underwater specific gravity sensor.

6. The apparatus of claim 4 wherein the means for determining a level of oil in said domed top comprises a light refraction sensor.

7. The apparatus of claim 1 further comprising:

a) at least one float ring attached to said domed top; and b) a means for filling said at least one float ring with gas and water to help displace the weight of the domed top.

8. The apparatus of claim 1 wherein said chute has at least one buoyancy ring attached to said chute to help support said chute.

9. The apparatus of claim 1 wherein the chute has a ring attached to the bottom of the chute to keep the chute open during use.

10. The apparatus of claim 1 wherein the means for temporarily anchoring said apparatus to the sea floor include:

a) at least one concrete anchor; and b) at least one cable attached to said at least one concrete anchor and said apparatus.

11. The apparatus of claim 1 further comprising a means for removing oil from said domed top, said means being attached to said oil port.

12. The apparatus of claim 11 wherein the means for removing oil from said domed top comprise:

a) a length of hose, attached to said oil port; and b) a transfer port installed on a buoy for transferring said oil to a ship, said transfer port being attached to said length of hose.

13. The apparatus of claim 12 further comprising a seawater injected transfer pump, installed between said transfer port and said hose.

14. The apparatus of claim 1 further comprising a means for removing gas from said domed top, said means being attached to said gas vent.

15. The apparatus of claim 14 wherein the means for removing gas from said domed top comprise:

a) a gas line, attached to said gas vent;

b) a methane bladder attached to said gas line, said methane bladder having an outlet port;

c) an outlet pipe, attached to said outlet port;

d) a buoy, attached to said outlet pipe; and e) a discharge nipple installed on the buoy for collection of the gas by a vessel.

16. The apparatus of claim 15 further comprising:

a) a net placed over said methane bladder; and b) a means for anchoring said net to the seafloor.

17. The apparatus of claim 16 wherein the means for anchoring said net to the seafloor includes:

a) at least one weight; and b) a cable, attached to said at least one weight and to said net.

* * * * *